US005146257A

United States Patent [19]

Lemberger et al.

[11] Patent Number: 5,146,257

[45] Date of Patent: Sep. 8, 1992

[54] DEVELOPER SOLUTION REPLENISHMENT CONTROL SYSTEM FOR A DIGITAL IMAGING SYSTEM

[75] Inventors: Richard R. Lemberger, Forest Lake; Paul C. Schubert, Marine, both of Minn.

[73] Assignee: Minnesota Mining and Manufacturing Company, St. Paul, Minn.

[21] Appl. No.: 656,743

[22] Filed: Feb. 19, 1991

[51] Int. Cl.[5] ..... G03D 13/00

[52] U.S. Cl. ..... 354/298; 354/324

[58] Field of Search ..... 354/297, 298, 324, 334; 378/4, 12; 356/443, 444; 430/30, 399

[56] References Cited

U.S. PATENT DOCUMENTS 4,310,234 1/1982 Sakamoto et al. ..... 354/298

4,603,956 8/1986 Baker ..... 354/298

*Primary Examiner*—L. T. Hix

*Assistant Examiner*—D. Rutledge

*Attorney, Agent, or Firm*—Gary L. Griswold; Walter N. Kirn; Walter C. Linder

[57] ABSTRACT

A developer replenishment control system for a continuous tone digital imaging system of the type including a laser imager for exposing pixels on sheets of photographic film as a function of digital exposure values representative of an image and a film processor with a developer replenishment mechanism for developing the imaged film. The replenishment control system includes lookup table memory and processing circuitry. Developer replenishment data in the form of an array of digital exposure values and corresponding incremental developed emulsion areal density values representative of the amount of developer required to develop the associated exposed film pixels is stored in the lookup table memory. The processing circuitry accesses the lookup table memory as a function of the digital exposure values to determine the associated incremental developed emulsion density values. The incremental developed emulsion density values for each sheet of imaged film are summed to generate replenishment control signals. The replenishment mechanism of the film processor includes a pump and a controller. The controller actuates the pump as a function of the replenishment control signals to replenish developer used during the development of each sheet of film.

14 Claims, 3 Drawing Sheets

DEVELOPER SOLUTION REPLENISHMENT CONTROL SYSTEM FOR A DIGITAL IMAGING SYSTEM

BACKGROUND OF THE INVENTION

The present invention relates generally to digital imaging systems. In particular, the present invention is a developer solution replenishment control system for use in conjunction with digital imaging and film processing equipment.

Media processors are commonly used in the medical field to develop media imaged by continuous tone digital imagers. Digital imagers of this type are configured to receive input data generated by a magnetic resonance (MR), computed tomography (CT) or other type of scanner. The input data is typically a sequence of digital values representative of the scanned image. Image processing electronics within the imager processes the input data to generate a sequence of digital exposure values, each of which is representative of one of a plurality of intensity levels (eg., a grey scale) at a discrete pixel location on the visually observable image. The image processing electronics scales and maps the range of scanned input data values to a range of exposure values which will produce a useful continuous tone photographic image. This mapping operation is necessitated by the nonlinear relationship between the input data and its visual representation, and the nonlinear sensitometric response of the photographic medium to different intensities of light. The image processing electronics typically includes a lookup table of stored data characterizing the input data to exposure value transfer function. The lookup table is accessed by the image processing electronics as a function of the input data to determine associated exposure values.

The imager uses the exposure values to modulate the intensity of a laser or other beam of radiation as the beam is scanned about a photosensitive medium. The intensity of the radiation beam, and therefore the degree to which the photosensitive medium is activated at each pixel location, corresponds to the digital exposure value. The imaged photosensitive medium is subsequently developed by the processor to produce a hardcopy of the image.

Digital imagers and processors of the type discussed above are well known and in widespread use. The commercially available 3M Laser Imager and Laser Imager Plus utilize silver-halide photographic film as the photosensitive media. The silver-halide film imaged by these imagers can be developed in the 3M Model XP-515 Laser Processor which makes use of conventional silver-halide photographic development techniques.

Film media used with the photographic-type digital imagers described above is coated with a silver-based emulsion. Small amounts of the emulsion are activated and converted into metallic silver when struck by the laser beam. The greater the intensity of the laser beam that strikes a pixel area on the film, the greater the density of the metallic silver formed at that location. The imaged film is developed by passing the film through tanks of developing solutions which react with the activated emulsion to form a visible deposit of metallic silver. The density or amount of metallic silver at each pixel on the developed film corresponds to the degree to which the emulsion was activated when that individual pixel was struck by the laser beam. As a result, the greater the intensity of the light that reaches a given pixel on the film, the more emulsion that is activated and the denser the silver deposit on the developed image.

Automatic film processors require replenishment of the developer chemical solutions depleted during the development of silver-halide film. The rate at which the developer solutions are depleted depends upon the density (overall lightness or darkness) of silver on the developed film, and therefore the amount of activated emulsion on the imaged but undeveloped film. Conventional automatic film processors typically include a controller actuated replenishment mechanism for replenishing the developer solutions at a predetermined rate such as a specific volume per sheet of film developed, or at some other rate determined by the experience of the operator.

Since the amount of developer solution required depends upon the overall silver content of the film, a film with a greater content of silver will require greater amounts of developer solution. For this reason, fixed developer replenishment rates may not be sufficient if a number of high silver content films are developed in sequence. The result would be poorly developed film. On the other hand, developer solution is wasted if the replenishment rate is greater than that needed to maintain the required concentration.

A method for determining the supplementary amount of developing solution for a film processor used in conjunction with a half-tone dot image generator is disclosed in the Sakamoto et al. U.S. Pat. No. 4,310,234. As described in this patent, an analog width signal controls the width of half-tone dots recorded on photographic film. The width signal is applied to a converter and converted into a frequency variation for counting by a counter. The counter counts up integrally the values of the width signals as the frequency variations from the start to the end of the scanning operation of a sheet of film. The integrated value of the width signals corresponds to the total exposure area of the photographic film and, therefore, the supplementary amount of developing system. The integrated value of the width signals is transferred to the developer and used to control the supplementation of developing solution. However, this method is not configured for continuous tone digital imagers.

It is evident that there is a need for improved developer replenishment control systems and associated media processors used in conjunction with continuous tone digital imagers. The replenishment control system and media processor must be capable of replenishing the developer solutions at a sufficient rate to accommodate peak developer needs, yet prevent waste during periods when lesser amounts of developer are required. Any such systems must also be efficient and reliable to be commercially viable.

SUMMARY OF THE INVENTION

The present invention is a developer replenishment control system for a continuous tone digital imaging system of the type including a laser for exposing pixels of photographic film as a function of digital values representative of an image. The replenishment control system includes processing circuitry and memory. Developer replenishment data characterizing the relationship between the digital values and incremental developer replenishment values representative of the amount of developer required to develop associated exposed pixels on the film is stored in the memory. The processing circuitry accesses the memory as a function of the digital values to determine the associated incremental developer replenishment values, and generates replenishment control signals as a function of a sum of the incremental developer replenishment values.

In a preferred embodiment, the memory includes lookup table memory for storing the developer replenishment data in the form of an array of incremental developed emulsion areal density values and corresponding digital values. The processing circuitry generates the replenishment control signals as a function of the sum of the incremental areal density values for each sheet of imaged film.

In still other embodiments, the replenishment control system is coupled to the replenishment mechanism of a film processor. The replenishment mechanism includes a pump for controlling the flow of replenishment developer from a supply to a developing tank. A controller actuates the pump as a function of the replenishment control signals to replenish the developer consumed during the development of each sheet of imaged film.

The replenishment control system efficiently and accurately maintains the appropriate concentration of developer within the film processor. Peak developer needs are met, while waste is prevented during periods of lesser demand.

DETAILED DESCRIPTION OF THE PREFERRED EMBODIMENTS

Figure 1:
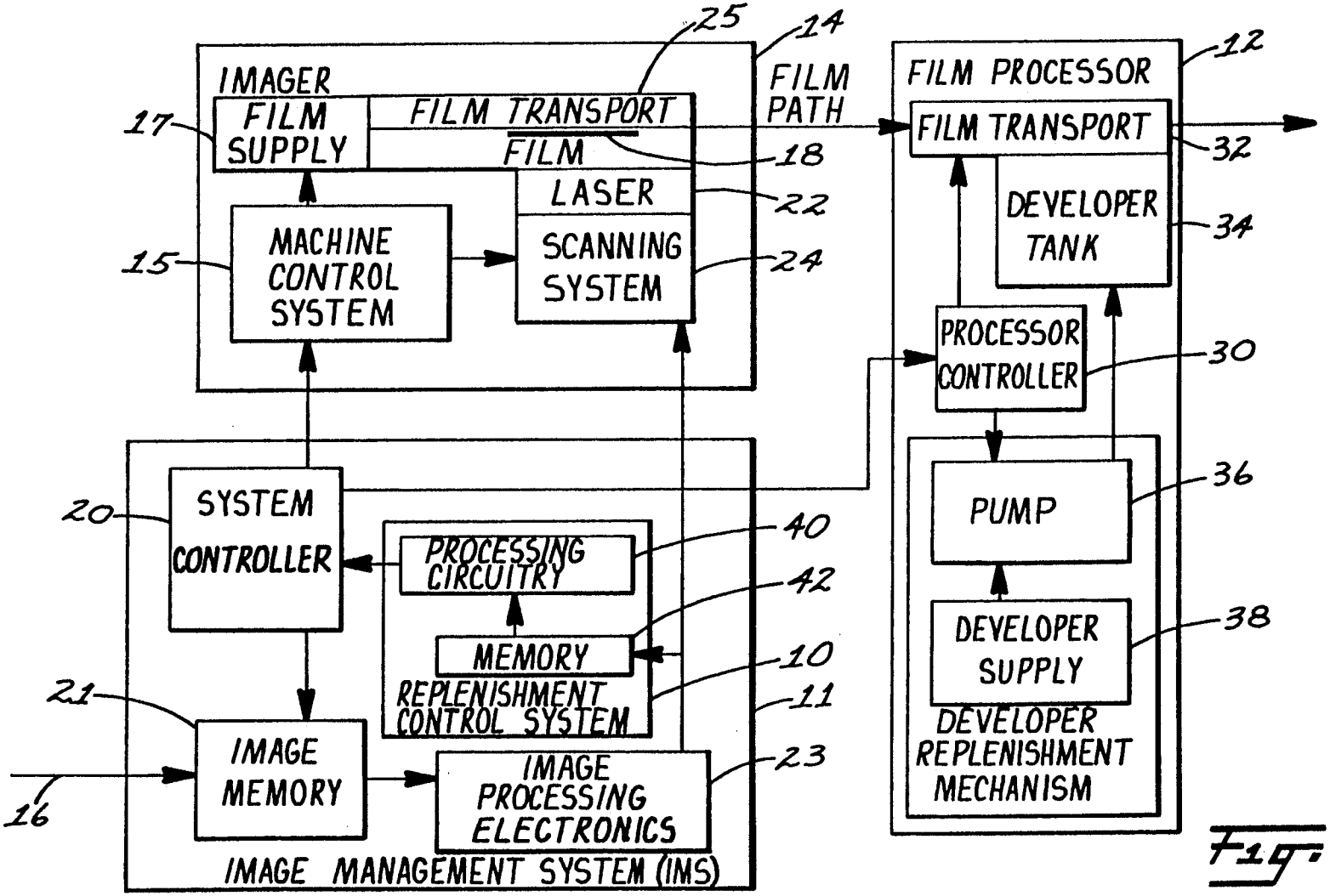
FIG. 1 is a block diagram representation of a developer replenishment control system in accordance with the present invention, as well as an associated film processor and their interconnections to a continuous tone digital imager.

A developer replenishment control system 10 and associated film processor 12 in accordance with the present invention are illustrated generally in FIG. 1. In the embodiment shown, replenishment control system 10 is a subsystem of an image management system (IMS) 11 configured to control the film processor 12 and a continuous tone digital imager 14. Digital imager 14 can be of any known or conventional design such as a 3M Laser Imager or Laser Imager Plus manufactured by Minnesota Mining and Manufacturing Company of St. Paul, Minnesota, U.S.A. IMS 11 includes an input port 16 for receiving a sequence of digital input data values representative of a scanned image and generated by a magnetic resonance (MR) or other scanner (not shown). IMS 11 processes the input data to generate a sequence of digital pixel exposure values. Imager 14 uses the pixel exposure values to print or image the image onto photosensitive media such as film 18. The imaged film 18 is subsequently developed by film processor 12.

The amount of developer solution used by film processor 12 to develop film 18 is related to the density (ie., degree of lightness or darkness) of the image on film 18. Developer replenishment control system 10 generates replenishment control signals as a function of the pixel exposure values generated by IMS 11. Film processor 12 receives the control signals from IMS 11 and replenishes the developer solutions at a rate determined by the signals.

In addition to replenishment control system 10, IMS 11 includes system controller 20, image memory 21 and image processing electronics 23. System controller 20 is a programmed microprocessor which controls IMS 11 and coordinates the operation of imager 14 and film processor 12. Image input data is temporarily stored in image memory 21 under the control of system controller 20. Image processing electronics 23 scales and maps the input data values to a range of digital pixel exposure values which can be used by imager 14 to produce a useful, continuous tone photographic image. The digital exposure values are representative of one of a plurality of intensity levels (eg., a grey scale) at discrete pixel locations of a visual representation of the scanned image. As shown in FIG. 1, the digital exposure values are transferred to both imager 14 and replenishment control system 10.

In the embodiment shown in FIG. 1, IMS 11, imager 14 and film processor 12 are configured for use with film 18 bearing a silver-halide emulsion. Imager 14 includes machine control system 15, film supply 17, laser 22, optical scanning system 24 and film transport 26 which cooperate to image film 18. Machine control system 15 is a microprocessor based system which interfaces with IMS system controller 20 and controls the operation of film supply 17, film transport 25 and scanning system 24. Laser 22 is connected to receive the pixel exposure values from image processing electronics 23. The radiation beam generated by laser 22 has continuously varying intensity levels determined as a function of the pixel exposure values. Scanning system 24 scans the laser beam across a line or row of film 18 while film transport 26 drives the film in a direction perpendicular to the scan, so that sequential rows are scanned adjacent to one another. Film transport 26 also transports the imaged film 18 to film processor 12.

Film processor 12 is docked or positioned directly adjacent to imager 14 in the embodiment shown, and includes controller 30, film transport 32, developer tank 34, pump 36 and developer supply 38. Pump 36 and developer supply 38 function as a developer solution replenishment mechanism. Controller 30 can be a programmed microprocessor and is interfaced to film transport 32. When actuated by controller 30, transport 32 drives imaged film 18 from imager 14 through developer tank 34. Controller 30 also actuates pump 36 to periodically replenish developer solution within tank 34 as the solution is depleted during the development process. The correct concentration of developer solution is thereby maintained within tank 34.

The silver-halide photographic process utilized in the embodiment of the invention described above is well known. Silver-halide emulsion on film 18 is activated and converted into metallic silver by the laser beam generated by laser 22. The amount of activated emulsion at each pixel on the film is functionally related to the intensity of the laser beam and therefore the associated pixel exposure value. As the imaged film 18 is transported through tank 34, the developer reacts with the emulsion to form a visible deposit of metallic silver. The amount of metallic silver at each pixel of the developed film (the incremental areal silver density value) is functionally related to the amount of activated emulsion. Since the amount of developer solution depleted from tank 34 as film 18 is developed depends upon the amount of silver on the imaged film, the rate at which the developer tank must be replenished from supply 38 depends upon the silver content of imaged film 18. Accordingly, the rate at which developer tank 34 must be replenished can be predicted or approximated from the pixel exposure values generated by IMS 11.

Replenishment control system 10 is connected to image processing electronics 23 and generates replenishment control signals representative of the silver content of the developed film 18 as a function of the pixel exposure values used to generate the image on the film. As shown in FIG. 1, replenishment control system 10 includes processing circuitry 40 and associated memory 42. In one embodiment, processing circuitry 40 is a programmed gate array interfaced to EPROM memory 42. Replenishment control system 10 can also be implemented with a programmed microprocessor or discrete circuitry.

Replenishment data characterizing the relationship between pixel exposure values and associated incremental image areal silver density values is stored within memory 42. This pixel exposure value/areal silver density value relationship can be determined by first making an analytical laboratory determination of the relationship between diffuse image density and areal silver density for a given incremental area of film 18. Image density is a parameter describing the degree of lightness or darkness of a given area of film 18. Density is defined as the common logarithm of the inverse of the transmittance ($D=\log(T^{-1})$), where transmittance T is the fraction of incident light which is transmitted through the area of film. Diffuse image density and areal silver density of the film are not linearly related because of scattering and absorption by the silver in the emulsion on film 18.

Figure 3:
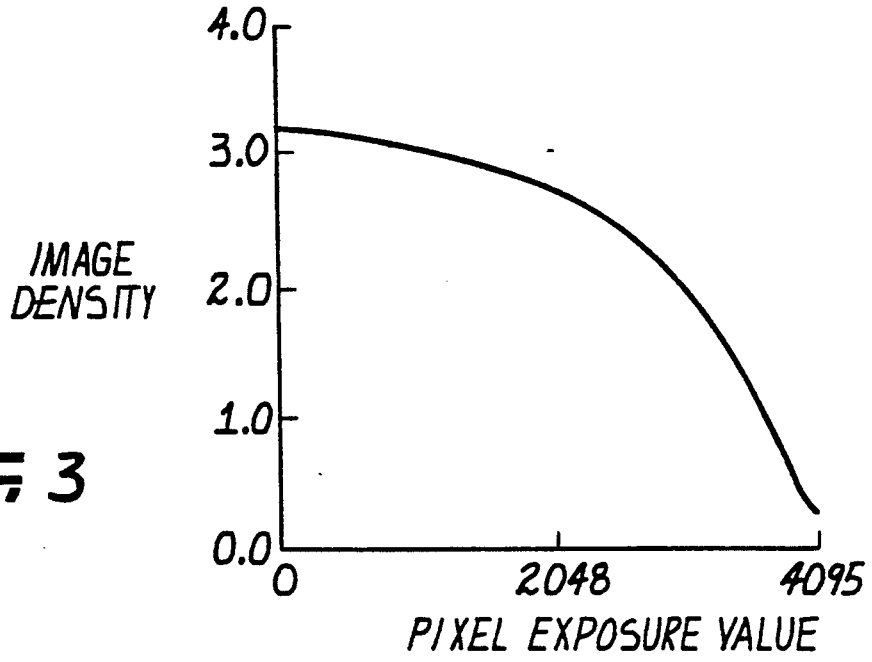
FIG. 3 is a graphical representation of pixel image density as a function of the pixel exposure values, for film imaged by the imager shown in FIG. 1.

The relationship between the pixel exposure values and the known film characteristics diffuse image density on film 18 can be determined from the image density versus log of the exposure value relationship and the dynamic power range of the hardware within imager 14. FIG. 3 is a graph illustrating a typical relationship between diffuse image density values and the associated pixel exposure values.

Figure 4:
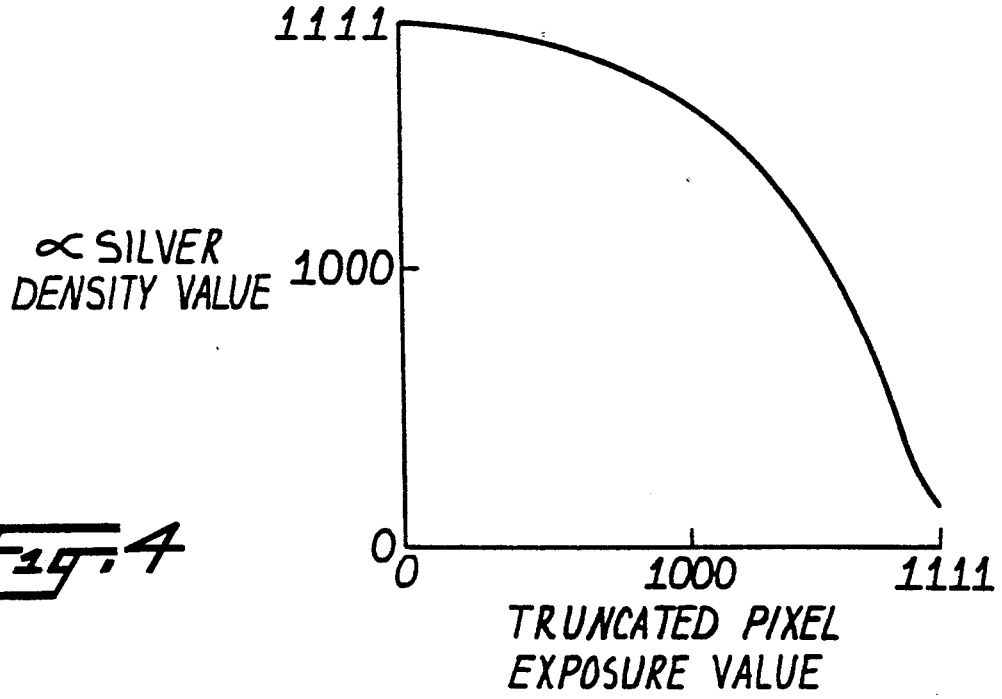
FIG. 4 is a graphical representation of the relationship between pixel areal silver density values and digital pixel exposure stored in the memory of the replenishment control system shown in FIG. 1.

From the information contained in the graph shown in FIG. 3 and the analytically determined diffuse image density/areal silver density relationship, the relationship between the digital pixel intensity values and associated incremental areal silver density values on film 18 can be determined. FIG. 4 is a graph illustrating the relationship between 4-bit pixel exposure values and associated scaled 4-bit areal silver density values.

In one embodiment, replenishment data characterizing the relationship illustrated in FIG. 4 is stored in a lookup table in memory 42. The lookup table is stored in memory 42 in the form of an array of data characterizing pixel exposure values and associated incremental areal silver density values.

Figure 2:
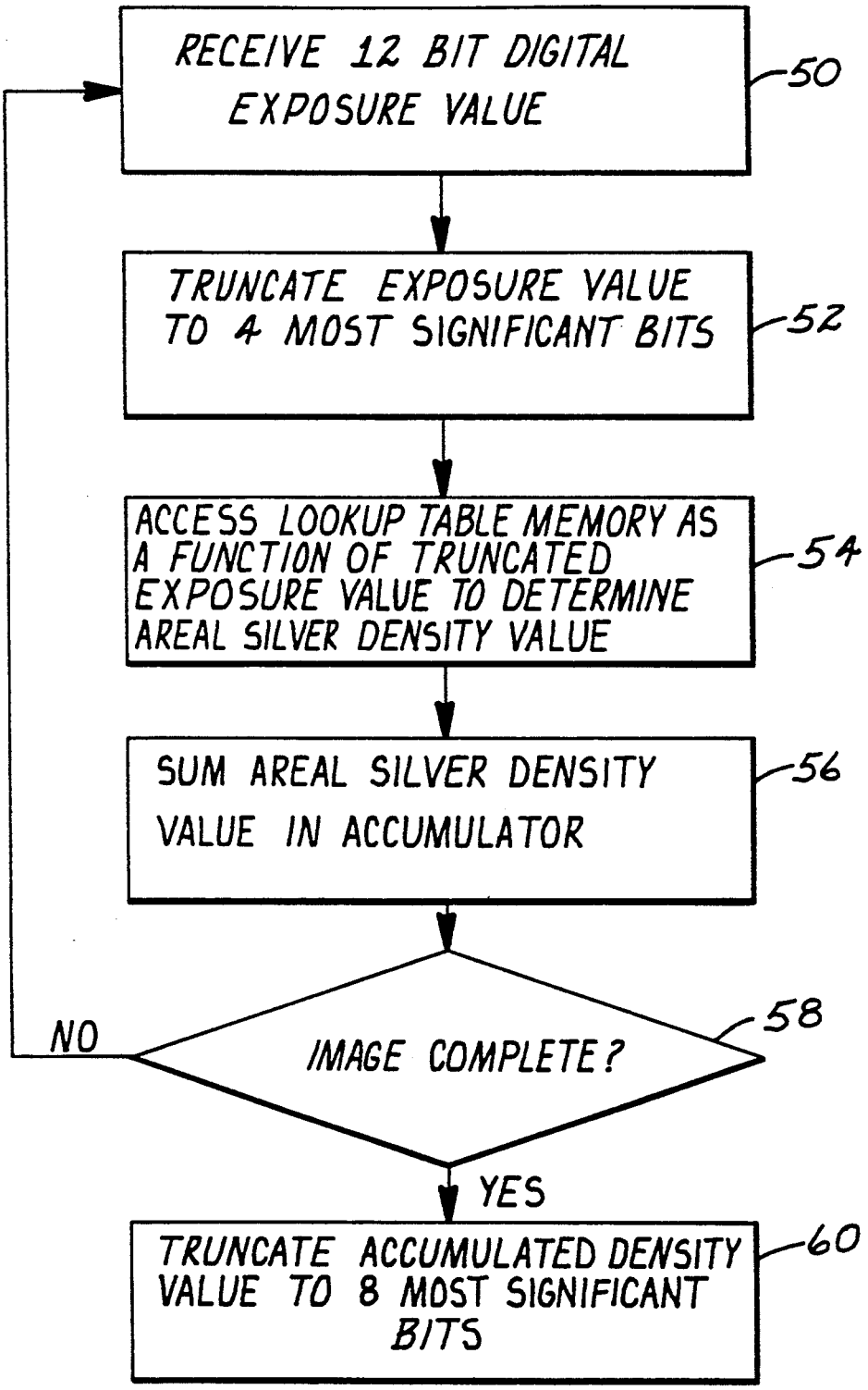
FIG. 2 is a flow chart describing the operation of the replenishment control system shown in FIG. 1.

The operation of replenishment control system 10 can be described with reference to the flow chart in FIG. 2. Replenishment control system 10 is connected to image processing electronics 23 and as indicated at step 50, receives the sequence of pixel exposure values representative of an image to be imaged by imager 14. In one embodiment, imager 14 receives and processes 12-bit pixel exposure values. However, sufficient accuracy for the developer replenishment function performed by film processor 12 can be achieved with less than 12-bit accuracy. To improve the efficiency of control system 10 and reduce the complexity of processing circuitry 40 and memory 42, the processing circuitry truncates the pixel exposure values to their four most significant bits. This operation is illustrated at step 52 in FIG. 2.

Following the truncation of the pixel exposure values, processing circuitry 40 accesses the lookup table in memory 42 as a function of the truncated digital values to determine the associated incremental areal silver density values. This action is shown at step 54 in FIG. 2. The incremental areal silver density values are accumulated or summed by processing circuitry 40. As indicated by step 58, truncation step 52, lookup table accessing step 54 and summing step 56 are repeated for each 12-bit pixel exposure value of a given image. An accumulated density value representative of the integrated or total amount of silver on imaged film 18 is thereby generated. In one embodiment summing step 56 is performed by processing circuitry 40 in a 28–30 bit accumulator. However, this large number of bits is more than needed for sufficient accuracy given other imprecision in the replenishment functions performed by film processor 12. The accumulated density value is therefore truncated to the eight most significant bits as shown at step 60. System controller 20 converts the truncated accumulated density values to corresponding replenishment control signals for transmission to film processor 12.

As shown in FIG. 1, film processor 12 is connected to receive the replenishment control signals generated by IMS 11. Replenishment control signals determined in the above-described manner are representative of the accumulated areal silver density values and therefore the amount of developer solution that will be required to develop the associated portion of film 18. Controller 30 of film processor 12 uses the replenishment control signals to control the rate at which developer solution in tank 34 is replenished.

In one embodiment, system controller 20 of IMS 11 is programmed with information characterizing the length of time that film processor pump 36 must be actuated to supply appropriate amounts of replenishment developer solution as a function of accumulated areal silver density values. After each sheet of film 18 is imaged, system controller 20 accesses this information as a function of the accumulated areal silver density value for the sheet to determine the appropriate length of time. Replenishment control signals in the form of a command describing the lengths of time that pump 36 should be actuated are generated by system controller 20 and transmitted to film processor 12. Pump 36 is then actuated by processor controller 30 for the appropriate length of time. The amount of developer solution used to process the associated sheets of film 18 is thereby transferred to tank 34. Although tank 34 is replenished at a rate of once per sheet of imaged film 18 in this embodiment, other rates can also be used to maintain the appropriate concentration of developer solution.

Developer replenishment control system 10 enables very accurate replenishment of developer solution within tank 34. Developer solution is not wasted if a sequence of sheets of film 18 having a low silver density are passed through developer tank 34. Successive sheets of high silver density film will also be properly developed since a sufficient concentration of developer is ensured. This accuracy is also efficiently achieved by control system 10 in a manner which will not significantly affect the overall cost of the system with which it is used.

Although the present invention has been described with reference to preferred embodiments, those skilled in the art will recognize that changes may be made in form and detail without departing from the spirit and scope of the invention.

What is claimed is:

1. A developer replenishment control system for a continuous tone digital imaging system of the type including a laser for exposing pixels of photographic film as a function of digital values representative of an image, the replenishment control system comprising:

memory for storing developer replenishment data characterizing the relationship between the digital values and incremental developer replenishment values representative of the amount of developer required to develop associated exposed pixels on the film; and processing circuitry for accessing the memory as a function of the digital values to determine associated incremental developer replenishment values, and for generating replenishment control signals as a function of a sum of the incremental developer replenishment values.

2. The developer replenishment control system of claim 1 wherein:

the imaging system is of a type configured to image sheets of photographic film; and the processing circuitry includes circuitry for generating replenishment control signals as a function of a sum of the incremental developer replenishment values for each sheet of imaged film.

3. The developer replenishment control system of claim 1 wherein:

the memory includes memory for storing the developer replenishment data in the form of incremental developed emulsion areal density values as a function of the digital values; and the processing circuitry includes circuitry for generating the replenishment control signals as a function of the sum of the incremental developed emulsion areal density values.

4. The developer replenishment control system of claim 1 wherein the memory includes lookup table memory for storing the developer replenishment data in the form of an array of digital values and corresponding incremental developer replenishment values.

5. The developer replenishment control system of claim 1 and further including a film processor coupled to the control system, the film processor including:

a developer tank; and a developer replenishment mechanism for replenishing the tank with developer as a function of the replenishment control signals.

6. The developer replenishment control system of claim 5 wherein:

the processing circuitry generates the replenishment control signals in the form of replenishment commands for controlling the replenishment mechanism; and the developer replenishment mechanism includes:

a developer supply;

a transport mechanism for controlling the flow of developer from the supply to the tank; and a controller responsive to the processing circuitry for actuating the transport mechanism as a function of the replenishment commands.

7. The developer replenishment control system of claim 6 where in the processing circuitry includes circuitry for generating replenishment commands representative of the amount of time of transport mechanism actuation.

8. The developer replenishment control system of claim 6 wherein the transport mechanism includes a pump.

9. A developer replenishment control system for a continuous tone digital imaging system of the type including a laser for exposing pixels on sheets of photographic film as a function of digital exposure values representative of an image and a film processor with a developer replenishment mechanism for developing the exposed film, the replenishment control system including:

lookup table memory for storing developer replenishment data in the form of an array of digital exposure values and corresponding incremental developer replenishment values representative of the amount of developer required to develop associated exposed pixels of the film; and processing circuitry for accessing the lookup table memory as a function of the pixel exposure values to determine associated incremental developer replenishment values, and for generating replenishment mechanism control signals as a function of a sum of the incremental developer replenishment values.

10. The developer replenishment control system of claim 9 wherein:

the lookup table memory includes memory for storing the developer replenishment data in the form of an array of digital exposure values and corresponding incremental developed emulsion areal density values; and the processing circuitry includes circuitry for generating the replenishment mechanism control signals as a function of the sum of the incremental developed emulsion areal density values.

11. The developer replenishment control system of claim 10 wherein the developer replenishment mechanism includes:

a developer supply;

a transport mechanism for controlling the flow of developer from the supply; and a controller responsive to the processing circuitry for actuating the transport mechanism as a function of the replenishment mechanism control signals.

12. The developer replenishment control system of claim 11 wherein the processing circuitry includes circuitry for generating replenishment mechanism control signals representative of the amount of time the transport mechanism is to be actuated.

13. The developer replenishment control system of claim 11 wherein the transport mechanism of the development replenishment mechanism includes a pump.

14. The developer replenishment control system of claim 11 wherein:

the processing circuitry generates the replenishment control signals as a function of a sum of the incremental developed emulsion areal density values for each sheet of imaged film; and the controller of the replenishment mechanism actuates the transport mechanism for each sheet of imaged film.

* * * * *